US009764387B2

(12) United States Patent
Petree

(10) Patent No.: US 9,764,387 B2
(45) **Date of Patent: *Sep. 19, 2017**

(54) POLYCRYSTALLINE DIAMOND COMPACT WITH INCREASED IMPACT RESISTANCE

(71) Applicant: Rusty Petree, Houston, TX (US)

(72) Inventor: Rusty Petree, Houston, TX (US)

( * ) Notice: Subject to any disclaimer, the term of this patent is extended or adjusted under 35 U.S.C. 154(b) by 9 days.

This patent is subject to a terminal disclaimer.

(21) Appl. No.: 14/623,948

(22) Filed: Feb. 17, 2015

(65) Prior Publication Data

US 2015/0158085 A1 Jun. 11, 2015

Related U.S. Application Data

(63) Continuation of application No. 14/099,285, filed on Dec. 6, 2013, now Pat. No. 8,986,406.

(60) Provisional application No. 61/734,756, filed on Dec. 7, 2012.

(51) Int. Cl.

| | |
|---|---|
| ***C22C 26/00*** | (2006.01) |
| ***B22F 7/06*** | (2006.01) |
| *B22F 5/00* | (2006.01) |

(52) U.S. Cl.

CPC ..... *B22F 7/06* (2013.01); *C22C 26/00* (2013.01); *B22F 2005/001* (2013.01)

(58) Field of Classification Search

CPC ..... B22F 7/06; C22C 26/00; E21B 10/46

See application file for complete search history.

(56) References Cited

U.S. PATENT DOCUMENTS

| | | | | |
|---|---|---|---|---|
| 4,224,380 | A | 9/1980 | Bovenkerk et al. | |
| 4,636,253 | A | 1/1987 | Nakai et al. | |
| 4,729,440 | A | 3/1988 | Hall | |
| 4,899,922 | A * | 2/1990 | Slutz | B23K 31/025 228/121 |
| 5,002,828 | A | 3/1991 | Cerceau | |
| 5,127,923 | A | 7/1992 | Bunting et al. | |
| 5,173,091 | A * | 12/1992 | Marek | B24D 3/06 451/527 |

(Continued)

FOREIGN PATENT DOCUMENTS

| | | | |
|---|---|---|---|
| EP | 0517510 | A2 | 12/1992 |
| IN | 06880DN2006 | A | 8/2007 |
| KR | 1020110099684 | A | 9/2011 |

OTHER PUBLICATIONS

I. Reineck, et al., "HCDCA Diamond-Coated Cutting Tools",—Abstract Only—from Diamond and Related Materials, vol. 5, Issues 6-8, May 1996, 1 page <http://www.sciencedirect.com/science/article/pii/0925963595004688>.

(Continued)

*Primary Examiner* — Pegah Parvini

(74) *Attorney, Agent, or Firm* — Kinney & Lange, P.A.

(57) ABSTRACT

A polycrystalline diamond (PCD) with diamond grains includes a first zone of the diamond grains and a second zone of the diamond grains. The first zone forms a working surface and a first catalyzing material is disposed within voids of the diamond grains in the first zone. A second catalyzing material is bonded to the diamond grains disposed in the second zone. The first catalyzing material in the first zone is connected to the diamond grains disposed in the first zone less intimately than the second catalyzing material is bonded to the diamond grains in the second zone.

12 Claims, 7 Drawing Sheets

(56) References Cited

U.S. PATENT DOCUMENTS

| | | | | |
|---|---|---|---|---|
| 6,132,675 | A | 10/2000 | Corrigan | |
| 6,344,149 | B1 | 2/2002 | Oles | |
| 6,410,085 | B1 | 6/2002 | Griffin et al. | |
| 6,435,058 | B1 | 8/2002 | Matthias et al. | |
| 6,481,511 | B2 | 11/2002 | Matthias et al. | |
| 6,544,308 | B2 | 4/2003 | Griffin et al. | |
| 6,562,462 | B2 | 5/2003 | Griffin et al. | |
| 6,585,064 | B2 | 7/2003 | Griffin et al. | |
| 6,589,640 | B2 | 7/2003 | Griffin et al. | |
| 6,592,985 | B2 | 7/2003 | Griffin et al. | |
| 6,601,662 | B2 | 8/2003 | Matthias et al. | |
| 6,739,214 | B2 | 5/2004 | Griffin et al. | |
| 6,749,033 | B2 | 6/2004 | Griffin et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 7,712,553 | B2 | 5/2010 | Shamburger | |
| 7,754,333 | B2 | 7/2010 | Eyre et al. | |
| 7,942,219 | B2 | 5/2011 | Keshavan et al. | |
| 7,980,334 | B2 | 7/2011 | Voronin et al. | |
| 8,020,642 | B2 | 9/2011 | Lancaster et al. | |
| 8,191,658 | B2 | 6/2012 | Schmitz et al. | |
| 8,342,269 | B1 | 1/2013 | Bertagnolli et al. | |
| 8,986,406 | B2 * | 3/2015 | Petree | 51/297 |
| 2005/0115744 | A1 | 6/2005 | Griffin et al. | |
| 2005/0129950 | A1 | 6/2005 | Griffin et al. | |
| 2005/0230156 | A1 | 10/2005 | Belnap et al. | |
| 2006/0086540 | A1 | 4/2006 | Griffin et al. | |
| 2006/0263233 | A1 * | 11/2006 | Gardinier | 419/11 |
| 2006/0266559 | A1 * | 11/2006 | Keshavan et al. | 175/428 |
| 2007/0079994 | A1 * | 4/2007 | Middlemiss | 175/426 |
| 2008/0142267 | A1 | 6/2008 | Griffin et al. | |
| 2008/0142275 | A1 | 6/2008 | Griffin et al. | |
| 2010/0011673 | A1 | 1/2010 | Shamburger | |
| 2011/0061944 | A1 * | 3/2011 | Scott | B01J 3/062 175/428 |
| 2011/0212303 | A1 | 9/2011 | Fuller et al. | |
| 2013/0000992 | A1 | 1/2013 | DiGiovanni | |

OTHER PUBLICATIONS

M. Yahiaoui, et al., "A Study on PDC Drill Bits Quality",—Abstract Only—from Wear, vols. 298-299, Feb. 15, 2013, 1 page <http://www.sciencedirect.com/science/article/pii/S0043164812004541>.

E. Hong, et al., "Tribological Properties of Copper Alloy-based Composites Reinforced with Tungsten Carbide Particles",—Abstract Only—from Wear, vol. 270, Issues 9-10, Apr. 4, 2011, 1 page <http://www.sciencedirect.com/science/article/pii/S004316481100024X>.

C. W. Knuteson, et al., "Wear-in Behaviour of Polycrystalline Diamond Thrust Bearings",—Abstract Only—from Wear, vol. 271, Issues 9-10, Jul. 29, 2011, 1 page <http://www.sciencedirect.com/science/article/pii/ S0043164811002304>.

* cited by examiner

140

| First Zone 142 | | Second Zone 144 | |
|---|---|---|---|
| Element | Wt % | Element | Wt % |
| Carbon | 88.64 | Carbon | 83.06 |
| Oxygen | 8.34 | Oxygen | 5.35 |
| Iron | 0.07 | Iron | 0.10 |
| Cobalt | 2.41 | Cobalt | 8.58 |
| Tungsten | 0.55 | Tungsten | 2.92 |
| 146 | 148 | 150 | 152 |

POLYCRYSTALLINE DIAMOND COMPACT WITH INCREASED IMPACT RESISTANCE

CROSS REFERENCE TO RELATION APPLICATIONS

This application is a continuation of U.S. application Ser. No. 14/099,285, filed on Dec. 6, 2013 and entitled, "Polycrystalline Diamond Compact with Increased Impact Resistance" by Rusty Petree. application Ser. No. 14/099,285 claims priority to U.S. Provisional Patent Application Ser. No. 61/734,756 filed on Dec. 7, 2012 and entitled "Polycrystalline Diamond Compacts with Increased Impact Resistance." Both application Ser. No. 14/099,285 and Provisional Patent Application Ser. No. 61/734,756 are herein incorporated by reference for all that they contain.

BACKGROUND OF INVENTION

The present invention relates generally to polycrystalline diamond (PCD) and, more specifically, to method of strengthening PCD compacts.

Polycrystalline diamond (PCD) materials are formed by combining diamond grains with a suitable catalyzing material under high pressure and high temperature conditions. Under such conditions, the catalyzing material promotes diamond-to-diamond bonding between the diamond grains. As a result, a PCD structure is formed. The resulting PCD structure has enhanced wear resistance and hardness characteristics that make the PCD structure useful in oil and gas drilling cutters and other applications. Catalyzing material is any material with the ability to help form bonds between adjacent diamond crystals. Examples of catalyzing material include but are not limited to cobalt, iron, and nickel.

A catalyzing material that is often used in PCD is cobalt. PCD typically comprises from 85% to 95% by volume diamond with catalyzing material, other elements, and void space comprising the remaining volume. The catalyzing material and other elements are found in the voids that exist between the bonded diamond grains. The catalyzing material facilitates diamond-to-diamond bonds between diamond grains in the PCD. Diamond to catalyzing material bonds are also formed under high pressure and high temperature.

As a traditional PCD tool or compact is used in abrasive applications, such as degrading a drilling formation, heat is generated at the working surface of the PCD compact where the PCD compact contacts the drilling formation. Heat causes the catalyzing material and the diamond grains in the PCD compact to expand at a rate consistent with their respective rates of thermal expansion. Often, the coefficient of thermal expansion of the catalyzing material is higher than the coefficient of thermal expansion of the diamond. As a result, the catalyzing material expands at a faster rate than the diamond grains. Consequently, the catalyzing material pushes on the diamond grains as they expand, which puts strain on the diamond-to-diamond bonds. Further, since the catalyzing material can also be bonded to the diamond grains, the catalyzing material also pulls on the diamond grains as they thermally expand, placing additional strain on the diamond-to-diamond bonds. If the strain on the diamond-to-diamond bonds is sufficient enough, the diamond-to-diamond bonds will break, resulting in thermal degradation of the PCD compact particularly when temperature begins to exceed 600° C. at the working surface. Common results of such thermal degradation in a traditional PCD compact include micro-cracks, cracks, chips, fractures, delaminating, and dulling of the cutting edge. Catastrophic breakage of the PCD can also occur.

One technique that has been used to prevent the thermal degradation issues from occurring in the PCD material during such drilling applications is to permanently remove substantially all the catalyzing material from just the volume adjacent the working surface of the PCD material. Thus, as the PCD material's working surface heats up there is no catalyzing material in the PCD material's surface to expand at a different rate than the diamond grains. However, the permanent removal of substantially all the catalyzing material from the volume adjacent the PCD material's working surface creates void space that can weaken the overall toughness and impact resistance of the cutter.

SUMMARY

In one aspect, a polycrystalline diamond (PCD) with diamond grains includes a first zone of the diamond grains and a second zone of the diamond grains. The first zone forms a working surface and a first catalyzing material is disposed within voids of the diamond grains in the first zone. A second catalyzing material is bonded to the diamond grains disposed in the second zone. The first catalyzing material in the first zone is connected to the diamond grains disposed in the first zone less intimately than the second catalyzing material is bonded to the diamond grains in the second zone.

BRIEF DESCRIPTION OF THE DRAWINGS

The accompanying drawings illustrate various examples of the principles described herein and are a part of the specification. The illustrated examples are merely examples and do not limit the scope of the claims.

DETAILED DESCRIPTION

In general, the principles described herein provide a PCD compact that is resistant to the thermal degradation issues experienced by many traditional PCD compacts and cutters while maintaining a high toughness and impact resistance. The principles described herein include at least a first zone and a second zone. The first zone forms a working surface and a volume adjacent to the working surface of the PCD compact containing a catalyzing material. The catalyzing material in the first zone is less intimately connected to the diamond than the catalyzing material in a second zone. The catalyzing material in the second zone is bonded to diamond that is adjacent a cemented metal carbide substrate.

In the following description, for purposes of explanation, numerous specific details are set forth in order to provide a thorough understanding of the present systems and methods. It will be apparent, however, to one skilled in the art that the present apparatus, systems, and methods can be practiced without these specific details. Reference in the specification to "an example" or similar language means that a particular feature, structure, or characteristic described is included in at least that one example, but not necessarily in other examples.

Figure 1A:
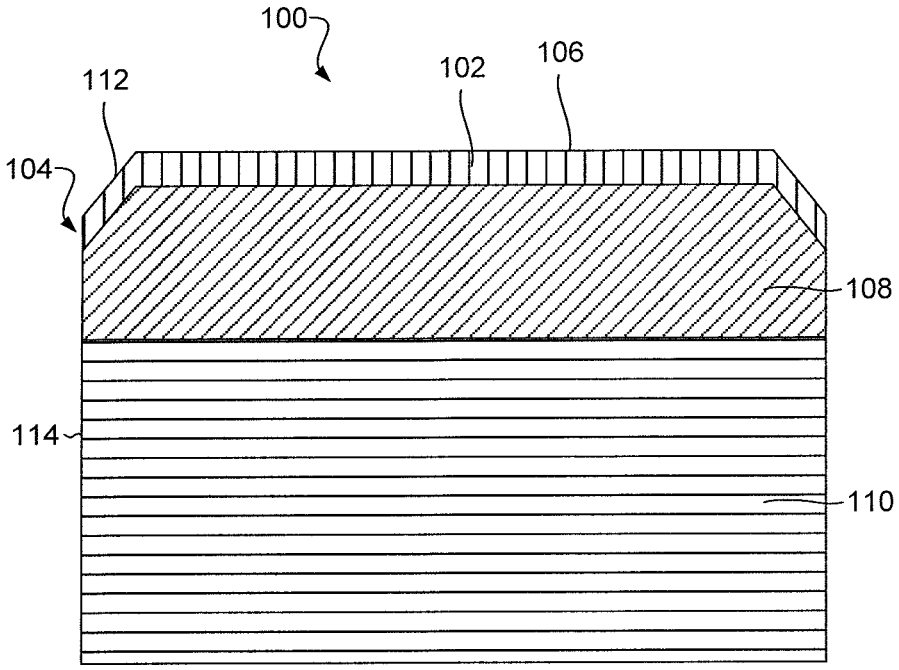
FIG. 1*a* is a cross sectional diagram of an example of a PCD compact according to the principles described herein.

FIG. 1*a* is a cross sectional diagram of an example of a PCD compact (100) according to the principles described herein. In this example, the PCD compact (100) can be a cutter that is well suited for attachment to drill bits used for oil and gas drilling, mining, geothermal applications, excavating, other rock or subterranean degradation applications, or combinations thereof. The PCD compact (100) has a first zone (102) of PCD (104) that forms a portion of the compact's working surface (106) and a second zone (108) of PCD (104) that is adjacent to a cemented metal carbide substrate (110). In the example of FIG. 1*a*, the working surface (106) of the PCD compact (100) is flat with a beveled cutting edge (112). The first zone (102) spans the entire working surface (106) and includes all of the beveled edge (112). In other examples, the first zone (102) can include a region just around the beveled edge (112) or another appropriate region that is less than the entire working surface (106). Also, the first zone (102) can extend to a periphery (114) of the PCD compact (100).

The cemented metal carbide substrate (110) is bonded to the second zone (108) of the PCD (104) in a high pressure, high temperature (HPHT) press. The cemented metal carbide substrate (110) can be a tungsten carbide substrate or can have other appropriate constituents known in the art to provide an adequate base for the PCD (104) and for bonding the PCD compact (100) to tools such as drill bits, reamers, picks, drums, bearings and the like. While sintering in the HPHT press, catalyzing material, such as cobalt, can be drawn out of the cemented metal carbide substrate (110) into the initially unbonded diamond grains of PCD (104) in both the second zone (108) and the first zone (102). As the catalyzing material enters into the unbonded diamond grains of the second zone (108) and the first zone (102), the catalyzing material catalyzes diamond-to-diamond bonds between the diamond grains, thereby forming a volume of sintered PCD (104). In some examples, the catalyzing material can be added directly to the unbonded diamond grains prior to the HPHT process to promote sintering. In other examples, mechanisms such as barriers positioned to impede a flow of catalyzing material from the cemented metal carbide substrate (110) into the volume of unbonded diamond grains can be employed to control the amount of catalyzing material that enters the unbonded diamond grains during sintering. Regardless of how the catalyzing material gets into the unbonded diamond grains, the catalyzing material is useful for lowering the temperatures and pressures needed to sinter the PCD (104). After the sintering process, the catalyzing material remains in the sintered PCD (104) in voids formed between the diamond grains. In addition to the diamond-to-diamond bonds, the catalyzing material forms diamond-to-catalyzing material bonds as well.

To reduce or eliminate the thermal expansion and toughness issues caused by the catalyzing material or permanent removal of catalyzing material as described above in the discussion of the prior art, the PCD (104) undergoes a treatment where catalyzing material in the first zone (102) and the working surface (106) is less intimately connected to diamond in zone (102) compared to zone (108).

Less intimately connected can mean that at least a portion of the catalyzing material in the first zone (102) is not bonded to diamond grains disposed within the first zone (102). Less intimately connected can also mean the catalyzing material in the first zone is substantially unbonded to the diamond grains in the first zone (102), or that the bonds between the catalyzing material and the diamond grains in the first zone (102) are weaker than the bonds found in the second zone (108). The catalyzing material in the first zone (102) remains unaltered by alloying, crystal structure changes, phase changes, mechanical working, thermal treatment or any other such method that results in altering the catalyzing ability of the catalyzing material.

During heat generating applications, such less intimately connected catalyzing material in the first zone (102) produces less strain in the PCD compact (100) compared to traditional PCD compacts containing intimately connected catalyzing material in the first zone (102), and also provides more structure and strength than traditional PCD compacts in which substantially all the catalyzing material has been permanently removed from volume (102). As such, when the catalyzing material expands within the first zone (102) of the PCD (104), the catalyzing material can expand and move within the voids without pulling and pushing on the diamond grains. This significantly reduces the residual stress in the PCD (104), thereby reducing thermally induced degradation of the PCD (104) and increasing the service life of PCD compact (100).

The process resulting in less intimately connected catalyzing material in the first zone (102) can include a process or method that does not cause diamond-to-catalyzing material bonds to form. A non-exhaustive list of methods include but is not limited to chemical vapor deposition, metal organic vapour phase epitaxy, electrostatic spray assisted vapour deposition (ESAVD), physical vapor deposition, cathodic arc deposition, electroless nickel plating or electroless cobalt plating, electron beam physical vapor deposition (EBPVD), ion plating or implantation, ion beam assisted deposition (IBAD), magnetron sputtering, pulsed laser deposition, sputter deposition, vacuum deposition, vacuum evaporation, evaporation (deposition), anodizing, conversion coating, chromate conversion coating, plasma metal coating, plasma electrolytic oxidation, phosphate coating, ion beam mixing, pickled and oiled plate steel coating, electroless plating, electroplating or electro injection, sol-gelling, plasma spraying, thermal spraying, plasma transferred wire arc thermal spraying, thermal diffusion, other appropriate methods, or combinations thereof.

A chemical vapor deposition method can involve suspending catalyzing material in gas that causes the catalyzing material to be deposited in the voids between the diamond grains in the first zone (102). In some examples, this process can use cobalt as the catalyzing material.

An electrolysis, electroless, or electroplating process can be used in conjunction with a vacuum system, magnetic system, ultrasonic agitation, or other mechanisms. The vacuum system can assist in getting a solution containing an electrically conductive catalyzing material that is suspended in fluid into the first zone (102) sufficient to establish electrical connectivity to carry out the process. A capillary effect can also be sufficient to move fluid from the working surface (106) to a depth with sufficient catalyzing material to establish electrical connectivity. However, this process cannot form diamond-to-catalyzing material bonding for catalyzing material such as cobalt because such cobalt-to-diamond chemical reactions typically occur at a high temperature (approximately 1300 degrees Celsius).

Electrolysis can be used to create less intimately connected cobalt-to-diamond connections. First, the cobalt or other type of catalyzing material can be removed or catalyzing material and diamond bonds broken with electrolysis, and then less intimately connected catalyzing material can be reinserted or packed into the voids of volume (102) by reversing the polarity of the voltage. In such an example, less intimately connected catalyzing material fills the voids in the first zone (102) of the PCD (104) and thus increases the strength of the PCD compact (100).

Adding some kinds of catalyzing material into the first zone (102) of the PCD (104), such as cobalt, can be added in solution. Such solutions can be used with or without the aid of electrolysis. The solution could be silicon, liquid glass, another suitable solution, or combinations thereof. The solution can fill the voids formed between the diamond grains via a capillary effect. The solution can be pushed into the voids using vacuum or cycling vacuum, atmospheric pressure, positive pressure, other mechanisms, or combinations thereof. If liquid glass is utilized as part of the solution, the solution must be raised to a temperature sufficient to form liquid glass (approximately 400 degrees Celsius).

For plasma spray coatings or sputter coating, the catalyzing material, such as cobalt, can be sprayed on the working surface (106) and allowed to seep into the void spaces disposed within the first zone (102). For electroless cobalt (or nickel) plating, the process causes the catalyzing material to penetrate the working surface (106) to a desired depth.

The processes used to add the catalyzing material into the first zone (102) can be accomplished at a relatively low pressure. For example, such a process can occur at a pressure lower than the pressures used to sinter diamond in a HTHP press. Such lower pressures can be at pressures that are less than a thousand pressure pounds per square inch (psi), less than five hundred psi, less than a hundred psi, at approximately atmospheric pressure, or less than atmospheric pressure.

Further, the processes used to enable less intimately connected catalyzing material in the first zone (102) can be accomplished at a temperature that is too low to cause a diamond-to-catalyzing material bond. Often cobalt, a suitable type of catalyzing material, reacts with diamond at a temperature around 1300 degrees Celsius. Thus, for processes used to produce a first zone (102) with less intimately connected catalyzing material, cobalt, the process occurs at a temperature less than 1300 degrees Celsius. In other examples, the temperature can be less than one thousand degrees Celsius, less than five hundred degrees Celsius, less than a hundred degrees Celsius, at room temperature, or less than room temperature.

Regardless of the method for producing a first zone (102) with less intimately connected catalyzing material, the catalyzing material in the first zone (102) puts less strain on the diamond-to-diamond bonds because the catalyzing material has more room to move within the voids found within the first zone (102) than the catalyzing material in the second zone (108). As a result, the overall PCD compact (100) exhibits an increased amount of thermal stability and increased impact resistance.

The catalyzing material in the first zone (102) can be equal to the amount of catalyzing material in the second zone (108). In some examples, the amount of catalyzing material in the first zone (102) is less than the amount of catalyzing material in the second zone (108). Further, the concentration of catalyzing material in the first zone (102) can be greater than the catalyzing material in the second zone (108).

Also, the catalyzing material in the first zone (102) can occupy less than the entirety of the volume of the first zone (102). In such an example, the first zone (102) can include a first sub-portion that contains the less intimately connected catalyzing material and a second sub-portion that has little or no catalyzing material. Such a second sub-portion can be formed deeper in the first zone (102) than the first sub-portion, and the first sub-portion can include the working surface (106) and area directly adjacent to the working surface (106).

In some examples, zone (102) contains a different catalyzing material than in zone (108). In other examples zone (102) contains the same catalyzing material as in zone (108) with the only difference being that the catalyzing material in zone (102) is less intimately connected to diamond than in zone (108). Other material could also be added into the first zone (102) at low temperature and pressure including transition elements such as tungsten, tantalum, niobium, titanium, or other similar transition element. Some of these transition elements have lower thermal expansion than cobalt and also have the ability to improve the impact toughness of the PCD compact (100) when inserted into the void space of the first zone (102).

In some examples within the scope of the invention, the diamond-to-catalyzing material bonds that were formed during the HTHP process in the first zone (102) are broken in situ. As a result, the catalyzing material in the first zone (102) is free to move and thermally expand in the voids of the first zone (102) of the PCD (104).

Figures 1B, 1C:
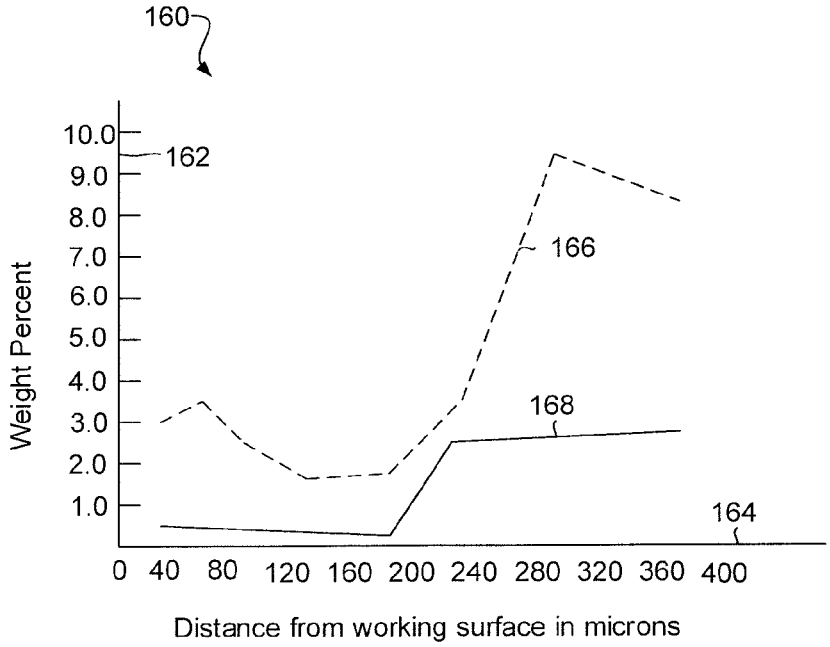
FIG. 1*b* is a chart of an example of the constituents in a first zone and a second zone according to the principles described herein.
FIG. 1*c* is a graph of an example of the constituents in a first zone and a second zone according to the principles described herein.

FIG. 1*b* is a chart (140) of an example of the constituents in the first zone (102) and the second zone (108) of the PCD compact (100) that was tested in a drilling application according to the principles described herein. The PCD compact (100) was a 13 mm diameter round shear cutter. The first zone (102) spanned the entire length of the cutter and included the beveled edge (112) of the PCD (104). The depth of the first zone (102) ranged from about 200 microns to 225 microns from the working surface (106) of the PCD (104). One of the PCD compacts (100) used in the drilling test was further analyzed, the results of which are disclosed in the chart (140) of FIG. 1*b*. The chart (140) includes a first zone (142) that extends from the working surface to a depth of approximately 220 microns and a second zone (144) that extends from the first zone (142) to the tungsten carbide substrate of the PCD compact (100). The first zone (142) includes an element column (146) and a weight percent column (148). The second zone (144) includes another element column (150) and a weight percent column (152). These amounts were determined through analysis with a scanning electron microscope.

The chart (140) indicates that the constituents of the first zone (142) include 88.64 weight percent of carbon, which is the diamond grains. Another 8.34 weight percent was oxygen. The catalyzing material in the first zone (142) includes 0.07 weight percent of iron, 2.41 weight percent of cobalt, and 0.55 weight percent of tungsten. The chart (140) indicates that the constituents of the second zone (144) include 83.06 weight percent of carbon and 5.35 weight percent of oxygen. The catalyzing material in the second zone (144) includes 0.10 weight percent of iron, 8.58 weight percent of cobalt, and 2.92 weight percent of tungsten.

FIG. 1*b* is a chart (140) that shows the tested PCD compact (100) had a combined average catalyzing material amount of about 3 weight percent in the first zone (142) while the second zone (144) included an average of 12.5 weight percent of catalyzing material. The first zone included less catalyzing material than the second zone. Further following the process, the cobalt in the first zone (142) is in the voids of the first zone (142) under temperature and pressure conditions such that the catalyzing material in the first zone (132) is less intimately connected to diamond grains than catalyzing material in the second zone (144).

FIG. 1*c* is a graph (160) of an example of the constituents in the first zone (142) and the second zone (144) of the same PCD compact (100) that was described above in the chart (140) of FIG. 1*b*. The y-axis (162) represents weight percent, and the x-axis (164) represents a distance from the working surface in microns. The dashed line (166) represents cobalt and the solid line (168) represents tungsten. The graph (160) shows that a greater deposit of cobalt is found near the working surface of the PCD compact (100), which starts to decline at about 60 microns. The cobalt concentration dips to just below 2 weight percent at about 140 microns until about 200 microns where the first zone (142) ends and the second zone (144) begins. While the chart (140) and graph (160) above refer to specific weight percentages and distributions for a specific example, any weight percentages and distributions can be used in accordance with the principles described herein.

In some experiments, intimately connected catalyzing material, cobalt, was depleted from the first zone through a standard acidizing procedure, as described in U.S. Pat. No. 4,224,380. In other experiments an electro-plating process was utilized to deplete intimately connected catalyzing material. Less intimately connected catalyzing material, cobalt, was added into the voids of the first zone (102) utilizing an electroplating process. For example, the PCD compact (100) was submerged into a supersaturated ammonium cobalt(II) sulfate hexahydrate, 98%, solution. While specific reference is made to a particular type of solution, other solutions in varying proportions were utilized in some experiments such as combinations of cobalt/sodium sulfate and cobalt/sodium chloride or calcium cobalt and calcium hydroxide. In these examples, boric acid, sulfuric acid or other acids can be utilized as a buffer to control PH level during the process.

In a similar fashion, other solutions can be utilized resulting in other catalyzing materials in the void space of the first zone (102) of the PCD (104). For example, experiments were conducted to inject catalyzing material, nickel, into the void space. In these experiments, varying combinations of solutions and varying proportions of nickel (II) sulfate hexahydrate, nickel chloride, ammonium chloride, boric acid, zinc sulfate, sodium thiocyanate were utilized as the fluid medium in the process to inject nickel into the void space. Fluid is added during the process to maintain a constant level replacing fluid that evaporates.

Several methods were used to prepare the PCD (104) and assist with the process resulting in cobalt or another catalyzing material in the first zone (102) that is less intimately connected to diamond than catalyzing material in the second zone (108). Those methods of pretreatment and methods used during the treatment process include but are not limited to ultrasonic cleaning the PCD (104) in an acetone solution and/or a water and surfactant solution. Ultrasonic stimulation can also be utilized during the injection process of the catalyzing material. The PCD (104) can also be placed in a chamber while in the solution at a pressure less than atmospheric pressure before and/or during the catalyzing material injection process. The pressure can be cycled on a vacuum from atmospheric to less than atmospheric to aid in pulling the solution and catalyzing material into the void space. A magnetic field can also be utilized to assist in pulling the catalyzing material into the void space.

The catalyzing material injection process can be a multi-step or continuous process. For example an electro-plating process can be conducted for a period of time followed by a thermal diffusion process whereby the PCD (104) is subjected for a period of time to a temperature of approximately 250 degrees Celsius, and then the electro-plating process can be conducted again for a period of time. The thermal diffusion process can range in temperature from 200 degrees Celsius to 600 degrees Celsius. In any event, the thermal diffusion process is performed at a temperature and pressure below that in which the catalyzing material forms bonds with the diamond. In one experiment, a 1 mm thick cobalt plate was oriented approximately 5 mm from the working surface (106) of the PCD compact (100). In other experiments, the distance of a cobalt or nickel plate from the working surface (106) of the PCD compact (100) ranged from 2 mm to 15 mm.

The positive output of a DC power supply can be attached to the cobalt or nickel plate to serve as the anode. The negative output of a DC power supply can be attached to the cemented metal carbide substrate (110) connected to the PCD (104) and serves as the cathode. During an intimately connected cobalt removal process, the current flow is reversed from the current flow of less intimately connected cobalt injection process. The DC power supply can be set to deliver a constant direct current or can be set to pulse on and off. In this experiment, the power supply was set to pulse every microsecond at 0.5 amps on a 50% duty cycle. The voltage ranged from 3.5 to 4.5 volts. In other experiments, a continuous DC current was applied at a constant 0.1 amps to a constant 1 amp with voltage ranging from 2 to 8 volts. In other experiments, a pulsing DC supply was utilized with duty cycles ranging from 10% to 90% and pulse frequency ranging from 200 to 1200 hertz. In this experiment the current was applied for 12 hours. In other experiments the current was applied for 5 hours to 30 hours. This experiment was conducted at room temperature of approximately 25 degrees Celsius and at atmospheric pressure. Other experiments were conducted at temperatures ranging from 20 degrees Celsius to 45 degrees Celsius.

PCD compacts (100) formed using the above-described method were used on a drill bit in Midland County, Tex., U.S.A. along with other PCD not produced utilizing the principles described herein. The bit drilled approximately 5,000 feet in a variety of formations including sand, shale, and carbonates. The PCD (104) produced utilizing the principles described herein had less impact damage than PCD produced not utilizing the principles described herein.

PCD compacts (100) formed using the above-described method were also used on a drill bit in Alberta, Canada along with other PCD not produced utilizing the principles described herein. The bit drilled approximately 1,000 meters in a variety of formations. The PCD (104) produced utilizing the principles described herein had less diamond volume loss than PCD produced not utilizing the principles described herein.

Figure 2:
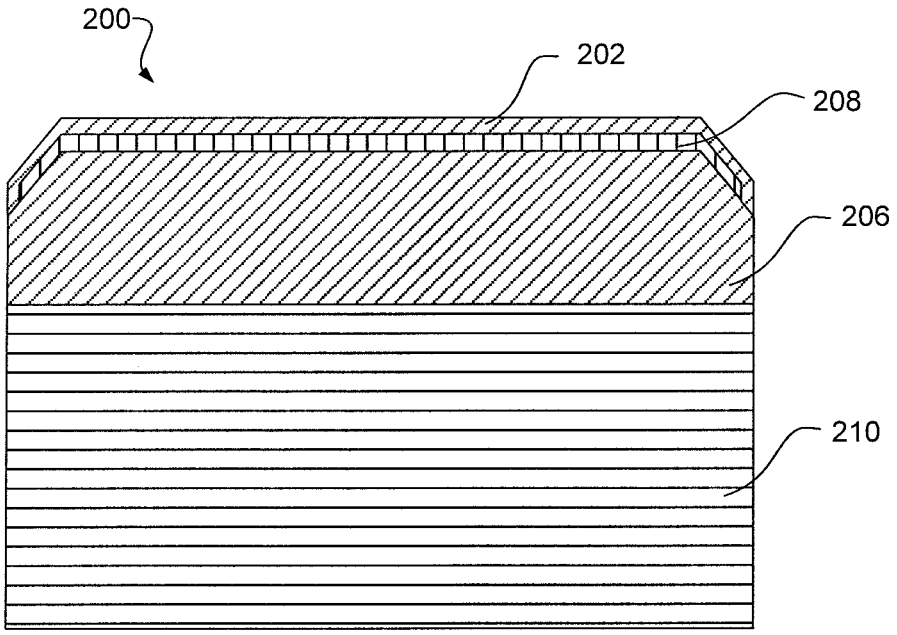
FIG. 2 is a cross sectional diagram of an example of a PCD compact according to the principles described herein.

FIG. 2 is a cross sectional diagram of another example of a PCD compact (200) according to the principles described herein. In this example, the PCD compact (200) includes PCD with a first zone (202), a second zone (206), and a third zone (208). The first zone (202) has catalyzing material that is less intimately connected to the diamond grains than in the second zone (206), the second zone (206) having catalyzing material that is bonded to the diamond grains with a HPHT bond. The third zone (208) is disposed between the first zone (202) and the second zone (206). A cemented metal carbide substrate (210) is bonded to the second zone (206). The first zone (202) can completely cover the third zone (208) and form a beveled edge of the working surface The third zone (208) can be substantially free of catalyzing material. Being substantially free of catalyzing material refers to the catalyzing material percentage by weight being less than one percent of the total weight of the material in the zone. The catalyzing material of the first zone (202) and the second zone (206) can be substantially the same type of catalyzing material or different types of catalyzing material, can have the same or different amounts of catalyzing material, and can have other different characteristics, or combinations thereof. Any appropriate type of catalyzing material can be used in the first zone (202) and the second zone (206).

The PCD compact (200) can be shaped to be shear cutters that can be well suited for shearing applications, such as for use in reamers, fixed cutter drag bits, other shearing applications, or combinations thereof. Such shear cutters can incorporate bevels, rounded edges, chamfers, non-planar or planar interfaces between the PCD and the substrate, planar or non-planar interfaces between the different zones of the PCD, where each zone can have at least one different characteristic, other features used in shear cutters, or combinations thereof. Such different characteristics between PCD zones can include grain size differences, thicknesses, types of catalyzing material, amount of catalyzing material, other different characteristics, or combinations thereof.

Figure 3:
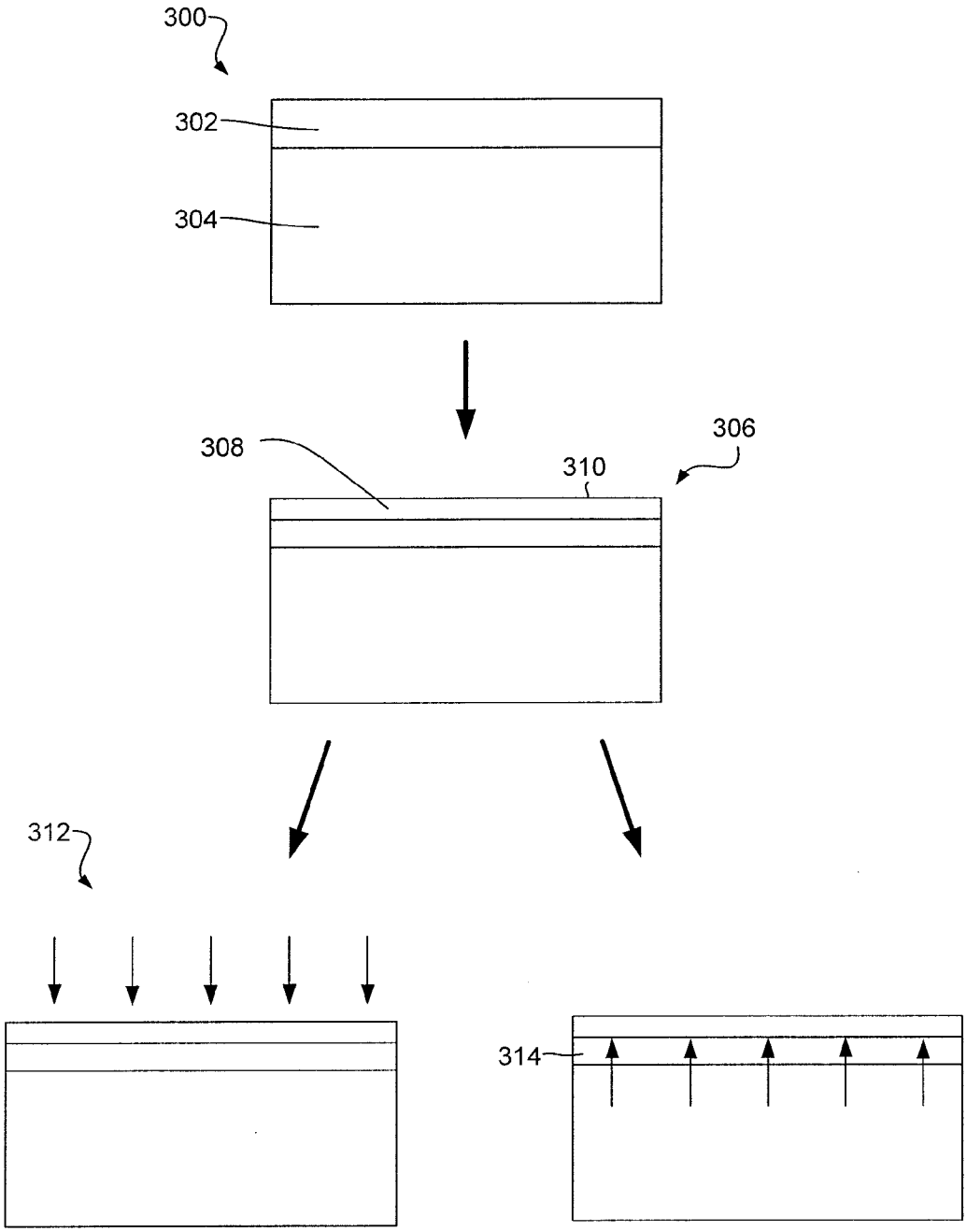
FIG. 3 is a diagram of an example of a process for manufacturing a PCD compact according to the principles described herein.

FIG. 3 is a diagram of an example of stages for manufacturing a PCD compact according to the principles described herein. First (300), a mixture of diamond grains and a substrate (304) are inserted into a HPHT press where the mixture of diamond grains is sintered to form PCD (302) joined to the substrate (304). In some examples, the mixture of diamond grains includes a premix of catalyzing material. In other examples, the sintering process relies entirely on catalyzing material being drawn out of the substrate (304) while subjected to the HTHP conditions of the HPHT press.

Next (306), catalyzing material is temporarily removed from a first zone (308) of the PCD (302) that comprises less than the entire volume of the PCD (302). The first zone (308) can form at least part of the working surface (310). During (306), just a portion of the catalyzing material is removed from the first zone (308). In other examples, the first zone (308) is substantially depleted temporarily of the catalyzing material to a predetermined depth. The predetermined depth can be a depth of five microns to eight hundred microns, or any depth there between. The predetermined depth can also be a depth of multiple average diamond grain sizes used within the volume of the PCD (302). For example, the grain size depth can be the depth of eight average diamond grains sizes in the volume of the PCD (302).

During (312), catalyzing material is added into the first zone (308). In some examples, the catalyzing material added to the first zone (308) is part of a continuous process that includes removing and inserting the catalyzing material as described above. Any appropriate method resulting in less intimately connected catalyzing material in the first zone (308) can be used in accordance with the principles described herein. The catalyzing material can be added into the first zone (308) from the working surface (310). Such examples can include an electro-plating or electro injection process.

In other examples, the catalyzing material is added to the first zone (308) from catalyzing material already existing in a second zone (314) of the PCD or in the substrate (304). Such examples can include an electrolysis process that causes the catalyzing material in the second zone (312) to be pulled out into the first zone (308). Multiple processes can be used in sequence or simultaneously to replace intimately connected catalyzing material with less intimately connected catalyzing material in the zone (308).

Figure 4A:
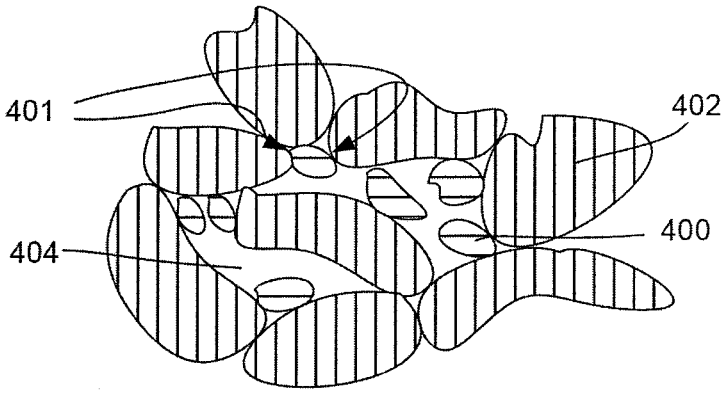
FIG. 4*a* is a diagram of an example of a process for manufacturing a PCD compact according to the principles described herein.
Figure 4B:
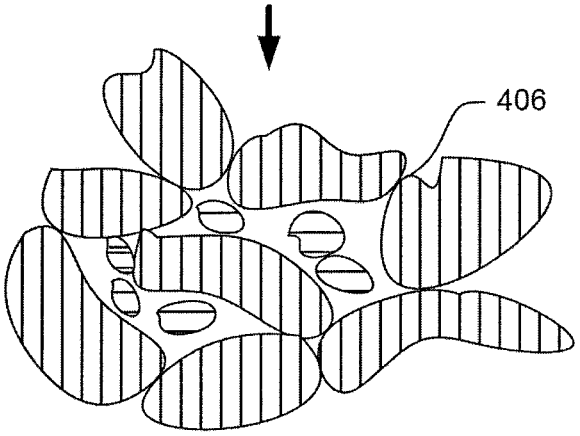
FIG. 4*b* is a diagram of an example of a process for manufacturing a PCD compact according to the principles described herein.

FIGS. 4*a* and 4*b* disclose an example of manufacturing a PCD compact according to the principles described herein. FIGS. 4*a* and 4*b* include a micron scale depiction of the process that results in a first zone with catalyzing material that is less intimately connected to the diamond grains.

As shown in FIG. 4*a*, after sintering in a HPHT press, elements (400) of the catalyzing material are bonded to diamond grains (402) of the PCD compact in voids (404) formed between the diamond grains (402). These bonds are referred to as diamond-to-catalyzing material bonds (401). The sintering process also causes diamond-to-diamond bonds (406) to form between diamond grains (402). The PCD compact then undergoes a treatment where the catalyzing material (400) is then less intimately connected to the diamond grains (402). Shown in FIG. 4*b*, following the process, the catalyzing material elements (400) in the first zone are disposed in the voids (404) formed between the diamond grains (402) where the catalyzing material elements (400) provide structural support to the diamond grains. However, most of the catalyzing material elements (400) are not bonded to the diamond grains (402). Consequently, when the catalyzing material elements (400) are subjected to a temperature sufficient to cause the catalyzing material elements (400) to expand, the catalyzing material (400) has more room to move and expand and imposes less strain to the diamond-to-diamond bonds (406). Thus, the PCD compact exhibits higher thermal stability and impact resistance which results in less thermal cracking and breakage of the PCD compact. The catalyzing material elements (400) in the first zone of the PCD can be any appropriate size sufficient to get into the voids (404) between the sintered diamond grains (402). In some examples, the average grain size of the catalyzing material elements is in the micro- and/or nano- scale.

A variety of tools can be made according to the present invention. Some non-limiting examples are shown in FIGS. 5-7.

Figure 5:
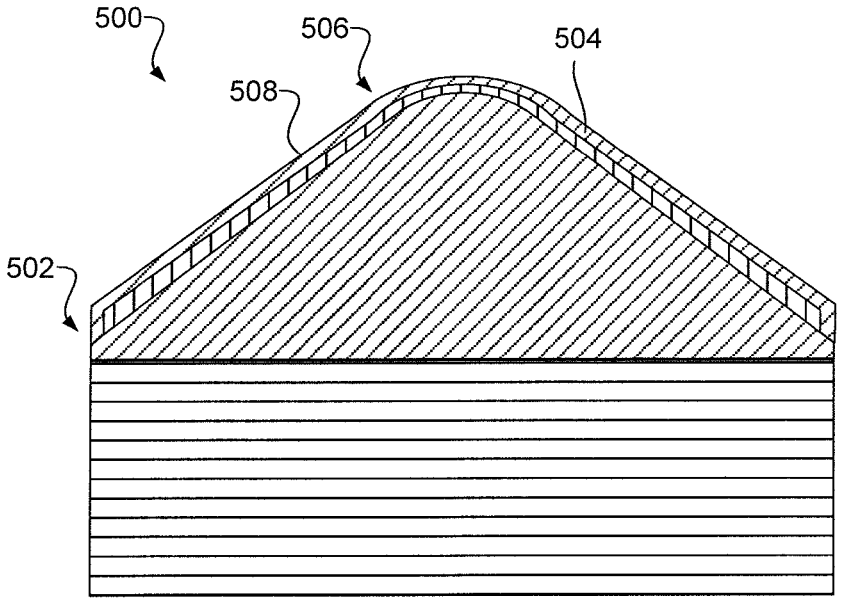
FIG. 5 is a cross sectional diagram of an example of a PCD compact according to the principles described herein.

FIG. 5 is a cross sectional diagram of an example of a PCD compact (500) according to the principles described herein. In this example, the PCD compact (500) is a chisel cutter with a conical profile (506), which can be well suited for roller cone bits, other tools, or combinations thereof. Here, the PCD compact (500) has a PCD (502) with a first zone (504) that includes less intimately connected catalyzing material. This first zone (504) follows the conical profile (506) of the PCD compact (500). As a result, the first zone (504) forms a conical shape as well.

In this example, the first zone (504) can have a consistent depth from the working surface (508) of the PCD compact (500). However, in other examples, the first zone (504) can have an increased or decreased depth adjacent the region of the working surface (508) that is intended to be the primary point of contact with a drilling formation. Furthermore first zone (504) can extend partially or completely down a side of the PCD (502).

Figure 6:
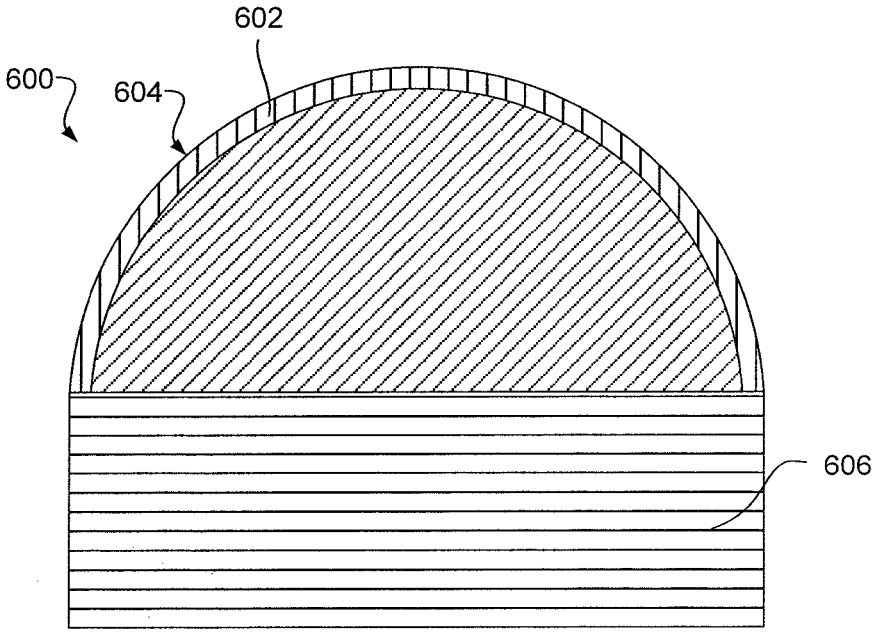
FIG. 6 is a cross sectional diagram of an example of a PCD compact according to the principles described herein.
Figure 7:
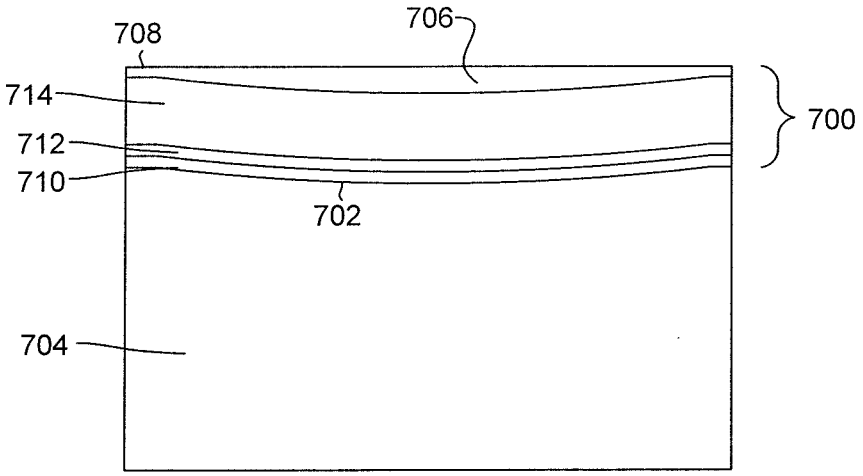
FIG. 7 is a cross sectional diagram of an example of a PCD compact according to the principles described herein.

FIG. 6 is a cross sectional diagram of an example of a PCD compact (600) according to the principles described herein. In this example, the PCD compact (600) has a dome shaped or rounded shape. The PCD compact (600) can be used for percussion bits, other tools, or combinations thereof. Here, a first zone (602) includes less intimately bonded diamond and follows a profile (604) of the PCD compact (600). Further, the first zone (602) can extend all the way along the profile (604) to a substrate (606) of the PCD compact (600).

FIG. 7 is a cross sectional diagram of an example of a PCD compact that includes PCD (700) according to the principles described herein. In this example, the PCD compact includes a non-planar concave interface (702) between the PCD (700) and the substrate (704). The first zone (706) includes less intimately connected catalyzing material and varies in depth.

The PCD compact shown in FIG. 7 is shaped for use in fixed cutter drill bits where traditional PCD compacts are susceptible to breakage due to the different thermal expansion coefficients of the material used in traditional PCD compacts. Using smaller particle size diamond grains in the PCD of traditional PCD compacts can provide better abrasion characteristics, but also makes the traditional PCD compacts more susceptible to breakage.

The PCD (700) of the PCD compact shown in FIG. 7 can be produced using multi-layers of carbide, diamond, and cobalt with each layer consisting of different percentages by weight of the materials and also different diamond particle sizes. This enables a less abrupt change in materials from the working surface (708) of the PCD compact to the substrate interface (702) resulting in a PCD (700) with higher durability and abrasion characteristics. The interface (702) between the substrate (704) and an adjacent layer (710) can be planar or non-planar and can have a concave shape with a relief height between 0.5 thousandths to 15 thousandths of an inch. The concave shape can cascade to a similar interface shape between each subsequent layer of the PCD (700).

For example, the adjacent layer (710) can be 5 thousandths to 15 thousandths of an inch thick and is comprised by weight 80% to 85% tungsten carbide, 0.5% to 10% cobalt, and 10% to 15% diamond, with the diamond grains varying in size from 5 to 10 microns. The next layer (712) is 5 thousandths to 15 thousandths of an inch thick and is comprised by weight 40% to 45% tungsten carbide, 3% to 12% cobalt, and 50% to 55% diamond, with the diamond grains varying in size from 30 to 50 microns. The mean particle size of this layer (712) can be about 40 microns. Another layer (714) can be 60 thousandths to 70 thousandths of an inch thick and is comprised by weight 5% to 10% tungsten carbide, 3% to 12% cobalt, and 85% to 90% diamond, with the diamond grains varying in size from 0.5 to 40 microns. The mean size for this layer (714) is 15 to 30 microns, but preferably 20 microns. The first zone (706), which forms the working surface (708), can be 2 thousandths to 15 thousandths of an inch thick and is comprised by weight 2% to 5% tungsten carbide, 1% to 5% cobalt, and 85% to 96% diamond, with the diamond grains varying in size from 0.05 to 40 microns. The mean particle size for this layer can range from 5 to 25 microns, but preferably the mean particle size is 10 to 15 microns. The volume adjacent to the working surface (708) in the first zone (706) is not substantially free of catalyzing material, but includes catalyzing material that is less intimately connected to the diamond grains.

Such a PCD (700) increases the impact resistance by reducing fracture oriented failures in the PCD (700). The press pressure used in the HTHP press to make the PCD compact can be greater than 8 GPa and the temperature can be between 1,250 degrees Celsius to 1,500 degrees Celsius. The chamfer finish can be 6RA or greater. The chamfer angle can be 40 to 75 degrees and 5 thousandths to 30 thousandths of an inch across the top. Making the change in materials less abrupt from the working surface (708) to the substrate (704) can improve the durability of the PCD (700). The first zone (706) provides a working surface with good abrasion characteristics and thermal stability. The PCD (700) has good durability and is more resistant to impact damage than traditional PCD due to the less abrupt changes in materials from one layer to the next. Testing through Finite Element Analysis and field results indicates that using multiple layers reduces abrupt thermal changes in those materials and reduces cracking caused from different thermal expansion coefficients of the materials. In other examples, all of the above described layers can be used, just some of the layers in different combinations and in different orders can be used, or just a single layer can be used.

To make the PCD compact shown in FIG. 7, the diamond constituents are placed in a press cell of an HPHT press and subjected to a HPHT process generally used for production of PCD elements. The HPHT press can be a computer-controlled press that subjects the PCD compact to pressure exceeding 7.5 GPa. A bevel of the working surface (708) can be finished to 6RA. The PCD compact is then attached to a fixed cutter bit body for use in drilling oil and gas wells by brazing the substrate (704) to the fixed cutter bit body.

Figure 8A:
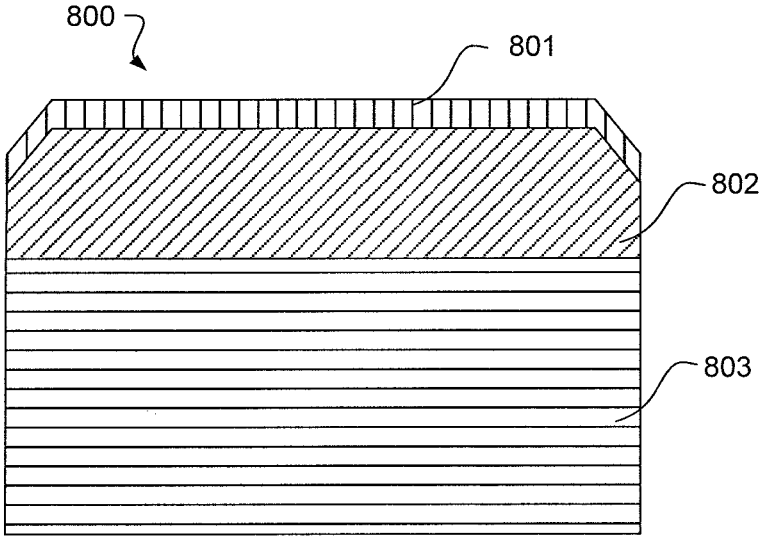
FIG. 8A is a cross sectional diagram of an example of the PCD compact according to the principles described herein.

FIG. 8A is a cross sectional diagram of an example of a PCD compact (800) according to the principles described herein. In this example, the PCD compact (800) includes a first zone (801) that has catalyzing material that is less intimately connected to the diamond grains in the first zone (801) than catalyzing material bonded to diamond grains in a second zone (802). The second zone (802) has catalyzing material that is bonded to the diamond grains with a HPHT bond. A cemented metal carbide substrate (803) is bonded to the second zone (802). The catalyzing material of the first zone (801) and the second zone (802) can be substantially the same type of catalyzing material or different catalyzing material, have the same or different amounts of catalyzing material, have other different characteristics, or combinations thereof. Any appropriate type of catalyzing material can be used in either the first zone (801) or the second zone (802). Other transition elements can be used in combination with the catalyzing material or independently.

The PCD compact (800) can be shaped to be a shear cutter that can be well suited for shearing applications, such as for use in reamers, fixed cutter drag bits, other shearing applications, or combinations thereof. Such shear cutters can incorporate bevels, rounded edges, chamfers, non-planar or planar interfaces between the second zone (802) and the substrate (803), non-planar or planar interfaces between the first zone (801) and the second zone (802), and other features used in shear cutters, or combinations thereof. Each zone can have at least one different characteristic. Such different characteristics between diamond zones can include grain size differences, thicknesses, types of catalyzing material, amount of catalyzing material, other different characteristics, or combinations thereof.

Figure 8B:
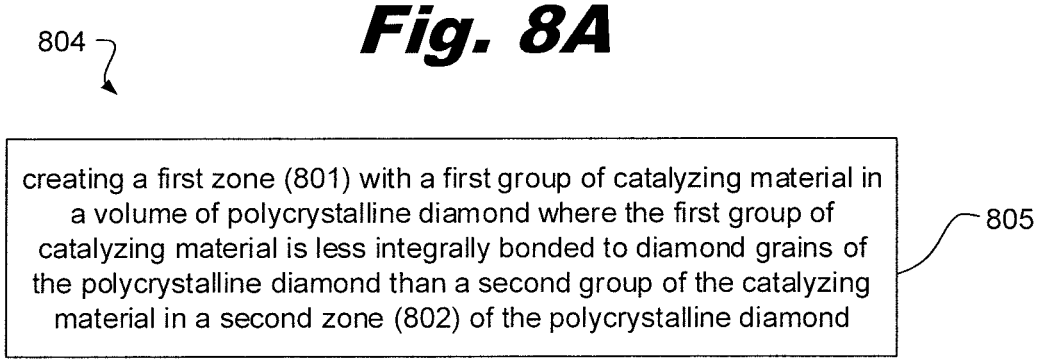
FIG. 8B is an example of method for forming a PCD compact according to the principles described herein.

FIG. 8B is a diagram of an example of a method (804) for forming a PCD compact according to the principles described herein. In this example, the method (804) includes creating (block 805) a first zone with a first group of catalyzing material in a volume of polycrystalline diamond (PCD) where the first group of catalyzing material is less integrally bonded to diamond grains of the PCD than a second group of the catalyzing material disposed in a second zone (802) of the PCD. The second zone (802) is attached to a carbide substrate (803).

In some examples, this method includes temporarily depleting the first zone of most of the catalyzing material disposed in the first zone. In other examples, some of the catalyzing material is not removed, but the bonds between the first group of catalyzing material and the diamond grains in the first zone are broken such that the catalyzing material in the first zone is less intimately bonded to the diamond grains in the first zone than the diamond-to-catalyzing material bonds in the second zone.

The catalyzing material can be added to just a subzone of the first zone or to the entire volume of the first zone. Any appropriate process can be used to add the catalyzing material to the first zone as long as the process does not cause the catalyzing material to form a high temperature and/or high-pressure bond with the diamond grains in the first zone. Such processes can include electrically injecting catalyzing material into the first zone, growing the catalyzing material within the first zone, moving the catalyzing material in the second zone towards the working surface and into the first zone, adding the catalyzing material into the first zone from a working surface side of the first zone. The process occurs at a temperature too low to form a diamond-to-catalyzing material bond, such as at a temperature that is less than four hundred degrees Celsius. In some examples, the process takes place under atmospheric conditions.

The PCD compacts can use any appropriate diamond grain size, such as 0.5 to 200 microns in width, length, or height. The PCD compacts can have different diamond thicknesses, diamond-to-substrate interface shapes, side angles, catalyzing material types, catalyzing material amounts, other characteristics, and/or combinations thereof. The catalyzing material can be any appropriate catalyzing material, such as metals, semiconductors, carbonates, other catalyzing material with the ability to promote sintering of the PCD, or combinations thereof. A non-exhaustive list of catalyzing materials can include cobalt, nickel, copper, tungsten, or some other transition elements from the periodic table, carbonates, other catalyzing material, and/or combinations thereof.

The PCD compacts can be formed with any appropriate method used in the art. U.S. Pat. Nos. 4,224,380 and 5,127,923, which are herein incorporated for all that each contains, discloses compatible methods for initially forming a PCD compact and removing a portion of the catalyzing material therefrom. The PCD compacts can be used for any appropriate applications such as drilling, reaming, mining, bearing cutting, machining, excavating, wire drawing, other application, or combinations thereof.

The preceding description has been presented only to illustrate and describe examples of the principles described. This description is not intended to be exhaustive or to limit these principles to any precise form disclosed. Many modifications and variations are possible in light of the above teaching.

The invention claimed is:

1. A polycrystalline diamond (PCD) with sintered diamond grains, the PCD comprising:

a first zone of the sintered diamond grains forming a working surface;

a first catalyzing material disposed within voids formed between the sintered diamond grains in the first zone;

a second zone of the sintered diamond grains; and a second catalyzing material bonded to the sintered diamond grains disposed in the second zone, wherein a majority of the first catalyzing material in the first zone is not bonded to the sintered diamond grains disposed in the first zone, wherein the first catalyzing material comprises at least one percent of the total material weight of the first zone, and wherein the first catalyzing material is metallic.

2. The PCD of claim 1, wherein the second catalyzing material is metallic.

3. The PCD of claim 2, wherein the second catalyzing material is different from the first catalyzing material.

4. The PCD of claim 3, wherein the first catalyzing material comprises a first transition element and the second catalyzing material comprises a second transition element.

5. The PCD of claim 4, wherein the first catalyzing material comprises nickel and the second catalyzing material comprises cobalt.

6. A polycrystalline diamond (PCD) compact with sintered diamond grains, the PCD compact comprising:

a first zone of the sintered diamond grains forming a working surface of the PCD compact;

a first catalyzing material disposed within voids formed between the sintered diamond grains in the first zone;

a second zone of the sintered diamond grains; and a second catalyzing material disposed between the sintered diamond grains within the second zone, wherein the second catalyzing material is bonded to the sintered diamond grains disposed within the second zone, wherein a majority of the first catalyzing material in the first zone is not bonded to the sintered diamond grains disposed within the first zone, wherein the first catalyzing material and the second catalyzing material are both metallic, wherein a concentration of the sintered diamond grains in the first zone is approximately 85% to approximately 95% by weight of the first zone, and wherein a concentration of the first catalyzing material in the first zone comprises approximately 3% by weight of the first zone.

7. The PCD compact of claim 6, wherein the second catalyzing material comprises a different element than the first catalyzing material.

8. The PCD compact of claim 6, wherein the first catalyzing material is disposed within the voids of only a sub-portion of the first zone proximate the working surface of the PCD compact.

9. The PCD compact of claim 6, wherein the first zone comprises a depth of approximately 5 microns to approximately 800 microns.

10. The PCD compact of claim 6, wherein the first zone comprises a depth from 200 microns to 380 microns.

11. The PCD compact of claim 6, wherein the first catalyzing material comprises a transition element.

12. The PCD compact of claim 6, wherein the second catalyzing material comprises a transition element.

* * * * *